United States Patent [19]

Cabrera et al.

[11] Patent Number: 4,822,642

[45] **Date of Patent: * Apr. 18, 1989**

[54] METHOD OF PRODUCING SILICON DIFFUSION COATINGS ON METAL ARTICLES

[75] Inventors: Alejandro L. Cabrera, Fogelsville; John F. Kirner, Orefield; Robert A. Miller, Allentown; Ronald Pierantozzi; John N. Armor, both of Orefield, all of Pa.

[73] Assignee: Air Products and Chemicals, Inc., Allentown, Pa.

[ * ] Notice: The portion of the term of this patent subsequent to Dec. 22, 2004 has been disclaimed.

[21] Appl. No.: 119,593

[22] Filed: Nov. 12, 1987

Related U.S. Application Data

[63] Continuation-in-part of Ser. No. 807,890, Dec. 11, 1985, Pat. No. 4,714,632.

[51] Int. Cl.[4] ..... C23C 16/24

[52] U.S. Cl. ..... 427/255.1; 427/255.3; 427/255.4; 427/318; 427/343

[58] Field of Search ..... 427/248.1, 255.1, 255.3, 427/255.4, 318, 343, 344

[56] References Cited

U.S. PATENT DOCUMENTS 3,902,930 9/1975 Sata et al. ..... 148/31.55
4,579,752 4/1986 Dubois et al. ..... 427/255
4,714,632 12/1987 Cabrera et al. ..... 427/255.1

FOREIGN PATENT DOCUMENTS 8514225 3/1987 France .
1530337 10/1978 United Kingdom .
2107360A 4/1983 United Kingdom .

OTHER PUBLICATIONS

A. Abba et al., "Protection of Iron Against Corrosion by Surface Siliconization", Materials Chemistry, vol. 5, 147–164, (1980).

M. Pons et al., Materials Chemistry and Physics, vol. 8, 153 (1983).

L. H. Dubois et al., "Reactivity of Intermetallic Thin films Formed by the Surface Mediated Decomposition of Main Group Organometallic Compounds", of Vac. Sci. and Tech., A2(2), 441–445 (1984).

*Primary Examiner*—Sadie Childs

*Attorney, Agent, or Firm*—Mark L. Rodgers; William F. Marsh; James C. Simmons

[57] ABSTRACT

A silicon diffusion coating is formed in the surface of a metal article by exposing the metal article to a reducing atmosphere followed by treatment in an atmosphere of 1 ppm to 100% by volume silane, balance hydrogen or hydrogen inert gas mixture. Hydrogen with a controlled dew point is utilized as a surface preparation agent and diluent for the silane.

35 Claims, 3 Drawing Sheets

METHOD OF PRODUCING SILICON DIFFUSION COATINGS ON METAL ARTICLES

CROSS REFERENCE TO PARENT APPLICATION

This is a continuation-in-part of U.S. patent application Ser. No. 807,890 filed Dec. 11, 1985 now U.S. Pat. No. 4,714,632 the subject matter of which is hereby incorporated by reference.

FIELD OF THE INVENTION

The present invention pertains to the formation of diffusion coatings in metal surfaces and, in particular, to the formation of silicon diffusion coatings.

BACKGROUND OF THE PRIOR ART

In the prior art it is known that objects which are to be exposed to reactive atmospheres at high temperatures may be rendered relatively inert, as compared to the base material, by deposition of a coating of metallic silicon or silicon oxide on the surface of the metallic article exposed to the reactive atmosphere and/or high temperature. In view of the fact that silicon dioxide has a high melting point, is unreactive toward many common atmosphere systems and has little catalytic activity, provision of such coatings is highly desirable. The fact that silicon dioxide has little catalytic activity has great value in such applications as equipment for steam cracking of hydrocarbons to produce ethylene. Secondary reactions which might result in the deposition of carbon on heat exchanger tubes are minimized with a silicon oxide coating on the exposed metallic surfaces in such reactors.

A number of processes are known and available for producing a siliconized surface on a metal, either to produce a silicon-rich or a silica coating. These methods are:

1. Molten metal or salt baths;
2. Pack cementation which transfers silicon to the metal by generating a volatile silicon compound in-situ by reaction between pack solids and a gas;
3. Surry/sinter, by which a slurry of silicon-containing powder is applied to a metal, dried and sintered to produce a silicon coating. In this category, silica coatings are produced by deposition of silica solids such as sols or sol gel and sintering;
4. Chemical vapor deposition of silicon via a gaseous or vaporized silicon compound;
5. Chemical vapor deposition of silica via gaseous silicon and oxygen sources;
6. Thermal spray of melted, atomized silicon-containing material on a metal substrate;
7. Ion implantation of silicon;
8. Physical vapor deposition of silicon or silicon oxide.

Chemical vapor deposition of silicon is one of the most desirable processes for a number of reasons, including such factors as uniform coating of the substrate, reatively low application temperatures and the option of forming a silicon diffusion layer, minimum cleaning of parts after treatment, no high-vacuum requirement, and the fact that the parts are amenable to continuous processing, ease of surface cleaning and post treatment. In particular, silane ($SiH_4$) is an attractive source of silicon because it is a gas containing only hydrogen and silicon thus avoiding problems caused by other gaseous or gasified silicon species such as the corrosion of process equipment or volatilization of the substrate by halide and other reactions that prevent formation of a diffusion coating such as carbon deposition and formation of silicon dioxide.

With processes involving the reaction at the surface of the object being coated, with a silicon halide such as $SiCl_4$, $Si_2Cl_6$, etc., and hydrogen, the overall reaction results in the formation of metallic silicon and hydrogen chloride. Silicon applied in this manner at temperatures greater than 1,000° C. (1832° F.) tends to diffuse into the substrate metal to form solid solutions and intermetallic compounds. These diffused coatings are especially desirable because there is no abrupt discontinuity in either composition or mechanical properties between the underlying substrate and the silicon at the surface. However, halogen-based processes suffer from a number of drawbacks centered around the reactivity and corrosivity of hydrogen chloride and other halogen derivatives. For example, iron chloride, which may be formed in the reaction, is volatile and loss of material and/or alteration of the composition of the substrate may be serious.

Another method of depositing metallic silicon is by the thermal decomposition of silane ($SiH_4$) to yield silicon metal and hydrogen. British Pat. No. 1.530.337 and British Patent Application 2,107,360A describe methods of applying protective coatings to metal, metal with an oxide coating, or to graphite. Critical surfaces in nuclear reactors are protected from oxidation by coating with silicon at greater than 477° F. (250° C.) under dry, nonoxidizing conditions followed by oxidizing the coating at a similar temperature. but under conditions such that silicon oxidizes faster than the substrate. For example, the patentees point out in the '337 patent that the 9% chromium steel was first dried in argon containing 2% hydrogen by heating to approximately 842° F. (450° C.) until the water vapor concentration in the effluent was less than 50 ppm followed by an addition of silane to the gas stream wherein the chromium steel in the form of tubes aas treated for 24 hours at temperatures between 909° and 980° F. (480° C. to 527° C.). When treated for 6 days with a mixture containing 100 ppm of water vapor, the tubes exhibited a rate of weight gain per unit area less than 2% that of untreated tubes when exposed to carbon dioxide at 1035° F. (556° C.) for up to 4,000 hours. These are overlay coatings in contrast to the diffusion coatings prepared using silicon halide described above. For example, in patent application '360A, the applicants point out the importance of limiting the interdiffusion of Si with compounds of the substrate. These overlay coatings require long deposition times for their preparation. It is possible to form Si diffusion coatings using $SiH_4$ but this requires higher temperatures. French workers produced diffusion coatings (solid solutions and metal silicides) utilizing silane under static conditions at elevated temperatures. [A. Abba, A. Galerie, and M. Caillet, *Materials Chemistry,* Vol 5, 147–164 (1980); H. Pons. A. Galerie. and M. Caillet, *Materials Chemistry and Physics,* Vol. 8, 153 (1983).] For iron and nickel, these temperatures were as high as 1100° C. (2012° F.). Others have produced metal silicides using silane on nickel using sputter-cleaned metal surfaces under high vacuum conditions. [L. H. Dubois and R. G. Nuzzo, *J. Vac. Sci and Technol.,* A2(2), 441–445 (1984).]

Dubois, et al., U.S. Pat. No. 4,579,752 discloses a method of forming protective coatings on the surfaces of Groups IB, VB, VIB and VIII metals excluding vanadium and iron. The surface of the metal is contacted with silane gas. without a required $H_2$ pretreatment, and is subsequently oxidized to form a region containing both silicon and oxygen.

SUMMARY OF THE INVENTION

The present invention provides a process for producing a silicon diffusion coating on a metal surface by reaction of silane and/or silane-hydrogen mixtures with the metal surface at temperatures below 1,200° C. (2192° F.) preferably 350° C. to 1,000° C. The process includes a pretreatment step under a reducing atmosphere, preferably hydrogen, which is controlled as to the quantity of oxygen atoms present in the gas to make sure that the substrate is devoid of any barrier oxide coatings. In the case of pure hydrogen contaminated by water vapor, control can be effected by control of the dew point of the hydrogen. After the pretreatment, exposure to the silane, preferably diluted in hydrogen. provides the desired silicon diffusion coating. A third but optional step includes oxidation of the diffused silicon to provide a coating layer or film of oxides of silicon on the exposed surface of the treated article. The process differs from the prior art by utilizing lower temperatures to obtain diffusion coatings and achieves high deposition rates at these lower temperatures.

DETAILED DESCRIPTION OF THE PREFERRED EMBODIMENT

Figure 1A:
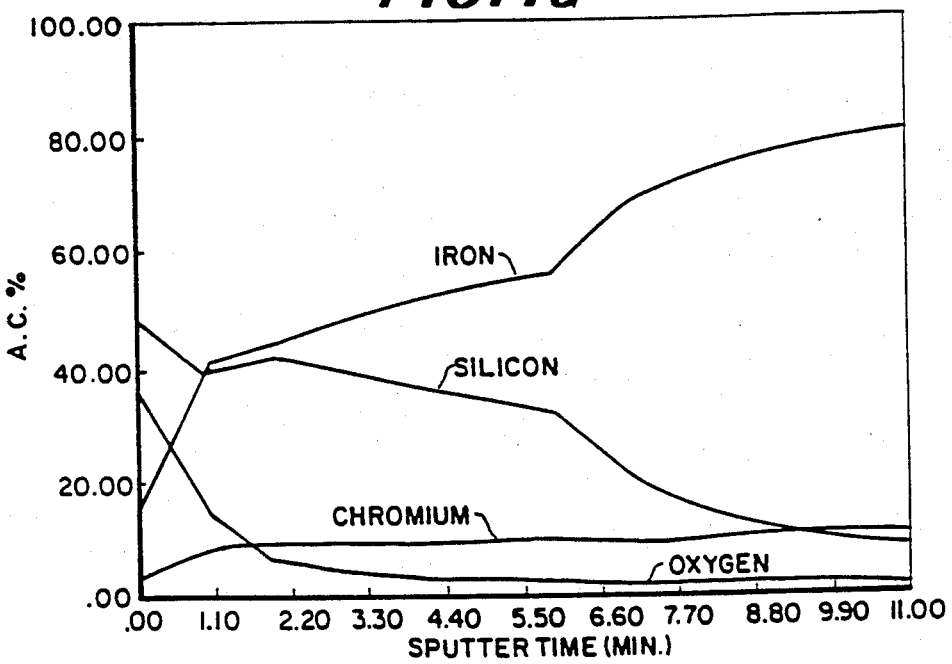
FIG. 1*a* is a plot of percent atomic concentration (A.C. %) of the critical elements determined by Auger Electron Spectroscopy (AES) against sputter time of a sample treated according to the present invention wherein the water vapor of the atmosphere was maintained at a maximum of 75 ppm during the silicon deposition step at 500° C.

The present invention is a process for siliconizing metallic surfaces by reaction of silane, either alone or diluted with hydrogen and/or hydrogen and an inert gas at temperatures below 1,200° C. (2192° F.) and preferably in a range of 350°-1000° C. to provide controlled silicon diffusion coatings in the metallic surface. The invention provides a process for protecting metal surfaces with the diffusion coating containing metal silicides and/or metal silicon solid solutions as significant portions of the total coating. A diffusion coating as opposed to an overlay coating is achieved by treatment conditions under which the surface is clean; i.e., there is no surface film which might act as a diffusion barrier to prevent migration of silicon into the metal being treated or migration of the elements of the metal by habit to the surface or which might act as a passive film to prevent surface catalysis of the silane ($SiH_4$) decomposition. According to the present invention a clean surface can be achieved by maintaining conditions during pretreatment such that the atmosphere is reducing to all components of the alloy that will react with oxygen.

The present invention comprises two primary steps with an optional third step. The first step of the invention includes a pretreatment wherein the metal article to be treated is exposed at an elevated temperature. i.e. up to 1200° C., preferably 400° to 1,000° C., although some substrates such as Cu can be reduced at substantially lower temperatures, under an atmosphere that is controlled to reduce or prevent formation of any oxide film which may act as a barrier coating. While numerous reducing atmospheres can be used, the preferred atmosphere is hydrogen which contains only water vapor as a contaminant at levels above 1 ppm. In this case the water vapor content (dew point) of the hydrogen is the control parameter. For example, in the treatment of low alloy steel the water vapor to hydrogen ($H_2O$ /$H_2$) molar ratio is maintained at a level that is less than $5\times10^{-4}$.

The second step comprises exposing the pretreated article to silane, preferably in a hydrogen carrier gas or in a hydrogen-inert gas mixture under reducing conditions. In the preferred form of the invention, the silane is present in an amount from 1 ppm to 100% by volume, balance hydrogen. However, it has been found that silane present in an amount of 500 ppm to about 5% by volume, balance hydrogen is very effective. Under these conditions, it has been found that if the molar oxygen content of the atmosphere is closely controlled during the treatment step, an effective diffusion coating is produced. In considering the molar oxygen content of the atmosphere all sources of oxygen (e.g. water vapor, gaseous oxygen, carbon dioxide or other oxygen donor) must be taken into account. For example, at 500° C. according to the present invention, the molar ratio of silane to oxygen (by this is meant the number of gram atoms of oxygen) ($SiH_4$/O) should be greater than 5 and the molar ratio of oxygen to hydrogen (O/$H_2$) should be less than $1\times10^{-4}$ for low alloy steel. Typically this step is carried out for metals which form silicides or Si-metal solid solutions at temperatures of less than about 1200° C. with a preferred range being from 350° to 1000° C., although some metals because of their high melting points, such as W, Mo, Ta and V, can be treated at the higher end of the temperature range (e.g., up to 1200° C.) while metals with lower melting points, such as Cu, can be treated at temperatures as low as 350° C. or possibly even lower. In general, the preferred treatment temperature is proportional to the melting point of the particular metal.

An optional third or post-treatment step comprises exposing the sample, treated according to the two steps set out above to oxidation potential conditions such that oxidation of silicon is favored over oxidation of the substrate by use of a water vapor-hydrogen, hydrogen-nitrogen-water vapor or hydrogen-nitrous oxide atmosphere wherein the molar ratio of oxygen to hydrogen ratio is controlled, to produce a silicon dioxide coating, film or layer over the silicon diffusion coating.

According to the present invention, the process is applicable to all substrates which are amenable to the diffusion of silicon such as ferrous alloys, non-ferrous alloys and pure metals. Specific examples of non-ferrous metals for which the present invention is particularly well suited include Cr, Cu, Mo, Ni, W, Pt, Au, Co, Ta, V, Ti and alloys thereof. Attempts to form silicon diffusion coatings by the method of the present invention in the surface of both Zn and Al substrates were not successful.

A large number of tests according to the present invention were conducted and are set out in the following examples.

The samples were inspected with X-ray fluorescence (XRF) to determine the elemental bulk composition fo deeper layers since the depth of penetration of this technique is about 3 μm. Elemental concentrations were calculated from XRF intensities using the respective X-ray cross sections for normalization, and they are also displayed in Table 1. The samples were also characterized by X-ray diffraction (XRD) to determine the phases present and it was found that the siliconzied surface is composed of two phases, FeSi and $Fe_3Si$. The predominant phase at 600° C. is $Fe_3Si$ while at 700° C. it is FeSi. The analysis are summarized in Table 1.

TABLE 1

Siliconized Fe Samples

| | Treatment in $SiH_4/H_2$ | | Bulk Composition (3 μm) | | Surface Composition (10 Å) | | Phases Present* | | |
|---|---|---|---|---|---|---|---|---|---|
| Sample No. | Temp (°C.) | t(min) | Si % | Fe % | Si % | Fe % | α-Fe | $Fe_3Si$ | FeSi |
| 1 | — | — | 0.1 | 99.9 | | 100 | S | — | — |
| 2 | 500 | 4 | 0.2 | 99.8 | 10.6 | 89.4 | S | W | — |
| 3 | 500 | 8 | 0.5 | 99.5 | 16.6 | 78.0 | S | W | W |
| 4 | 500 | 15 | 0.3 | 99.7 | 10.1 | 80.9 | S | W | W |
| 5 | 600 | 4 | 27.0 | 73.0 | 42.1 | 48.7 | W | S | M |
| 6 | 600 | 8 | 28.9 | 71.1 | 34.4 | 54.3 | — | S | M |
| 7 | 600 | 15 | 22.6 | 77.4 | 45.1 | 47.2 | W | S | S |
| 8 | 700 | 4 | 28.1 | 71.9 | 50.8 | 40.6 | W | M | S |
| 9 | 700 | 8 | 30.0 | 70.0 | 68.4 | 22.2 | W | M | S |
| 10 | 700 | 15 | 39.9 | 60.1 | 91.0 | 0.0 | W | M | S |

*S strong diffraction pattern intensity
M moderate intensity
W weak intensity

EXAMPLE 1

Samples of pure iron with approximate dimensions of 0.3×0.4×0.004" were mounted on the manipulator of a deposition/surface analysis system. Samples were spot-welded to two tungsten wires and heated by a high current AC power supply. The temperature of the sample was monitored by a chromel-alumel thermocouple which was spot-welded to one face of the sample.

The samples were pretreated in pure $H_2$ at a dew point = −60° C. ($P_{H2O}/P_{H2} = 1\times10^{-5}$), at a flow = 1100 standard cubic centimeters (scc)/min and heated at 800° C. for 60 min.

The $SiH_4/H_2$ treatment was performed without interrupting the $H_2$ flow. Premixed $SiH_4/H_2$ was added to the $H_2$ flow until a mixture (by volume) of 0.1% $SiH_4$ in $H_2$ was obtained. The samples were then heated at a temperature between 500°-700° C. for a time interval between 4–15 min, at a total flow = 1320 scc/min.

After the treatments were completed, the samples were analyzed by Auger electron Spectroscopy (AES) and the surface elemental compositions are listed in Table 1 below. All the samples are covered with a thin film of $SiO_2$ of about 70 Å which presumably was formed when the samples were exposed to oxygen contaminants prior to the surface analysis.

According to Example 1, the tests demonstrate the formation of iron silicide diffusion coatings on a pure iron substrate according to the present invention.

EXAMPLE 2

Samples of AISI type 302 stainless steel with approximate dimensions of 0.3×0.4×0.002" were prepared, mounted, and treated as in Example 1. A typical analysis by Atomic Absorption Spectroscopy (AAS) of the as-received material yielded a nominal composition 7% Ni, 18% Cr and 73% Fe.

The sample was heated at 700° C. for 15 min. in an atmosphere (by volume) of 0.1% $SiH_4/H_2$ at a total flow = 1,320 scc/min. After the treatment was completed, the surface was analyzed by Auger Electron Spectroscopy (AES) without removing the sample from the system thus minimizing atmospheric contamination. The surface composition is set out in Table 2, after treatment and after mild Argon ion ($Ar^+$) sputtering which probes the depth of the coating. The surface is enriched with Nickel (Ni) after the $SiH_4/H_2$ treatment and as determined by X-ray Photoelectron Spectroscopy (XPS) the Ni is in the form of Ni silicide.

TABLE 2

Analysis of Siliconized 302 SS

| | AES Atomic % | | | XPS Analysis | | |
|---|---|---|---|---|---|---|
| Element | After $SiH_4/H_2$ Treatment | After Ar+ Sputtering = 160 Å | Elements Detected | Binding Energy (eV) | References | Binding Energy (eV) |
| | | | Si* | 103.6 | $SiO_2$ | 103.4 |
| Si | 31.5 | 34.4 | Si | 99.7 | $Ni_2Si$ | 100.0 |
| C | 14.7 | — | Fe | 706.8 | Fe° | 706.8 |
| O | 30.7 | 2.3 | Cr | 574.1 | Cr° | 574.1 |
| Cr | — | 12.9 | Ni | 853.1 | $Ni_2Si$ | 853.1 |
| Fe | 10.7 | 42.5 | O | 532.7 | $SiO_2$ | 533.09 |

TABLE 2-continued

| Analysis of Siliconized 302 SS | | | | | | |
|---|---|---|---|---|---|---|
| | AES Atomic % | | | XPS Analysis | | |
| Element | After $SiH_4/H_2$ Treatment | After Ar+ Sputtering = 160 Å | Elements Detected | Binding Energy (eV) | References | Binding Energy (eV) |
| Ni | 12.5 | 7.9 | C | 284.8 | contamination | 284.6 |

*Two peaks corresponding to Si are present; nevertheless, the peak identified as $SiO_2$ is weak indicating that it comes from residual oxide. The C and O signals are also very weak.

The foregoing tests demonstrate the formation of a nickel silicide diffusion coating on an AISI type 302 stainless steel by the method of the present invention.

EXAMPLE 3

A sample of 1"×½"×0.004" AISI type 310 stainless steel foil was suspended using a quartz wire from a microbalance inside a quartz tube positioned in a tube furnace. The sample was treated in flowing dry $H_2$ (D.P.<−60° C.; $H_2O/H_2<1\times10^{-5}$) at 800° C. for 30 min., then cooled to 500° C. and treated in flowing dry 0.1% $SiH_4/H_2$ by volume (D.P.<−60° C.; $H_2O/H_2<1\times10^{-5}$) for a time (100 min.) long enough to deposit 0.5 mg Si. Surface analyses showed that the top 90 A was composed primarily of $SiO_2$ and Ni silicide. The oxide was presumably formed on exposure of the sample to air during transport. XPS analysis after removal of the oxide film is set forth in Table 3. Ni silicide is present on the surface of the sample as was found in Example 2. An AES depth profile using Ar ion sputtering showed that the surface layer contained (1) 600 Å of Ni silicide 2) 3000 Å region of a mixed Ni/Fe silicide with gradually decreasing Ni/Fe ratio, and (3) a region of about 3000 A which is rich in Cr relative to its concentration in the bulk alloy and depleted in Fe and Ni.

TABLE 3

| XPS Results | | | | |
|---|---|---|---|---|
| Element | Conc. rel. at. % | B.E. (eV) | Ref. B.E. | Ref. cpd |
| 1 Si (2p) | 48.5 | 99.4 | 100.0 | Si, $Ni_2Si$ |
| 2 Fe (2p) | 7.3 | 706.8 | 706.8 | Fe |
| 3 Ni (2p) | 44.1 | 853.2 | 853.1 | $Ni_2Si$ |

In summary, the results of Examples 2 and 3 show that for austentic stainless steel at 500° C. to 700° C., Ni and Fe have diffused to the surface to form a metal silicide layer, with Ni diffusion apparently being slightly faster than Fe, and have left behind a region depleted of these elements and rich in Cr.

EXAMPLE 4

Samples of 1"×¼"×1/16" coupons of alloy A182F9 (9% Cr/1% Mo/Fe) obtained from Metal Samples Co., were cleaned in an acetone sonic bath. The samples were then treated in a Cahn 2000 microbalance inside a quartz tube heated with a tube furnace. Gas flowed up the tube and exited at a sidearm. The following procedures were used for the treatment:

(1) Treat samples at 800° C. for 30 min. in flowing dry $H_2$ (D.P.<−60° C., $H_2O/H_2<1\times10^{-5}$).
(2) Lower temperature to treatment temperature and switch to $H_2$ flow with desired dew point.
(3) Admit 0.5% $SiH_4/H_2$ mixture (by volume) to give a total flow of $H_2/Si$; $H_4$=1220 cc/min. (15 min. at 600° C., 2.5 hr. at 500° C.).
(4) Turn off $SiH_4$, cool rapidly in $H_2$.
(5) Determine diffusion vs. overlay coating by AES depth profiling.

Figure 1B:
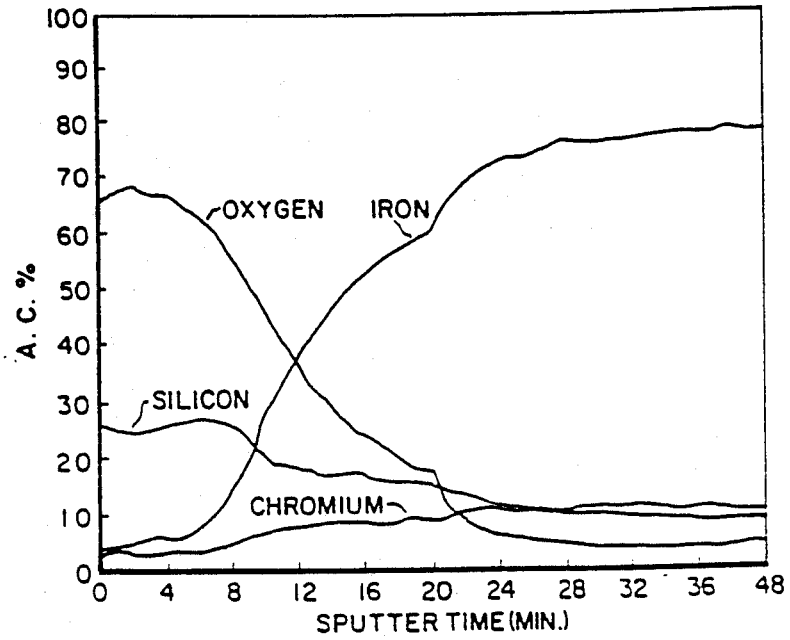
FIG. 1*b* is a plot similar to FIG. 1*a* wherein the water content was controlled to a maximum of 100 ppm during the silicon deposition step at 500° C.

Table 4 summarizes the results of the samples treated as set out above at 500° C. $H_2O$ levels of 75 ppm ($SiH_4/H_2O$)=6.7) and lower result in diffusion coatings according to the present invention whereas $H_2O$ levels of 100 ppm ($SiH_4/H_2O$=5) and higher will result in overlay coatings. FIG. 1*a* and FIG. 1*b* compare AES depth profiles for the diffusion coating at 75 ppm $H_2O$ to the overlay coating at 100 ppm $H_2O$. The sample surface in FIG. 1*a* was sputtered at a rate of 15 A/min for six minutes and then at a rate of 150 Å/min for five minutes. The sample surface of FIG. 1*b* was sputtered at a rate of 10 Å/min for twenty minutes and then at a rate of 130 Å/min for 28 minutes.

TABLE 4

| Run Number | $H_2O$ (ppm) | $SiH_4$ (ppm) | $SiH_4/H_2O$ | Temp. (°C.) | Coating Type |
|---|---|---|---|---|---|
| 1 | 100 | 500 | 5.0 | 500 | overlay |
| 2 | 75 | 500 | 6.7 | 500 | diffusion |
| 3 | 50 | 500 | 10.0 | 500 | diffusion |
| 4 | 20 | 500 | 25.0 | 500 | diffusion |
| 5 | 10 | 500 | 50.0 | 500 | diffusion |
| 6 | <10 | 500 | >50.0 | 500 | diffusion |

Table 5 summarizes the results of the samples treated as set out above at 600° C.

TABLE 5

| Run Number | $H_2O$ (ppm) | $SiH_4$ (ppm) | $SiH_4/H_2O$ | Temp. (°C.) | Coating Type | Wt. gain mg/cm$^2$ | Fe/Si AES |
|---|---|---|---|---|---|---|---|
| 1 | 200 | 500 | 2.5 | 600 | overlay | <.02 | >19 |
| 2 | 150 | 500 | 3.3 | 600 | diffusion | 0.03 | 1.88 |
| 3 | 100 | 500 | 5.0 | 600 | diffusion | 0.05 | 1.24 |
| 4 | 50 | 500 | 10.0 | 600 | diffusion | 0.15 | 1.24 |
| 5 | 20 | 500 | 25.0 | 600 | diffusion | 0.20 | 0.81 |
| 6 | <10 | 500 | >50 | 600 | diffusion | 0.43 | 0.46 |

Figure 2A:
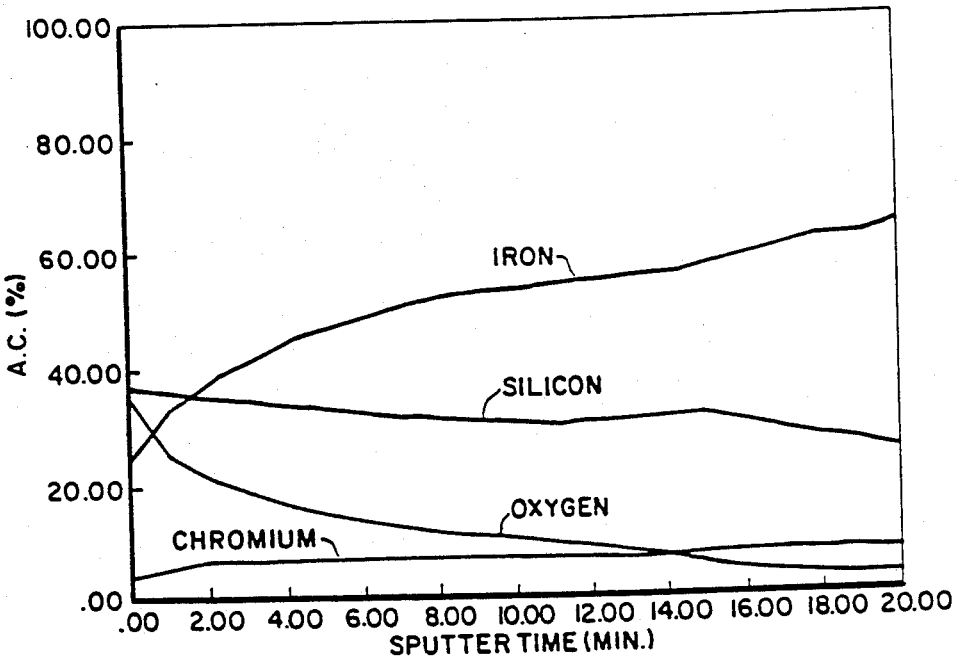
FIG. 2*a* is a plot similar to FIG. 1*a* of a sample treated according to the present invention wherein the water vapor was maintained at 150 ppm during the silicon deposition step at 600° C.
Figure 2B:
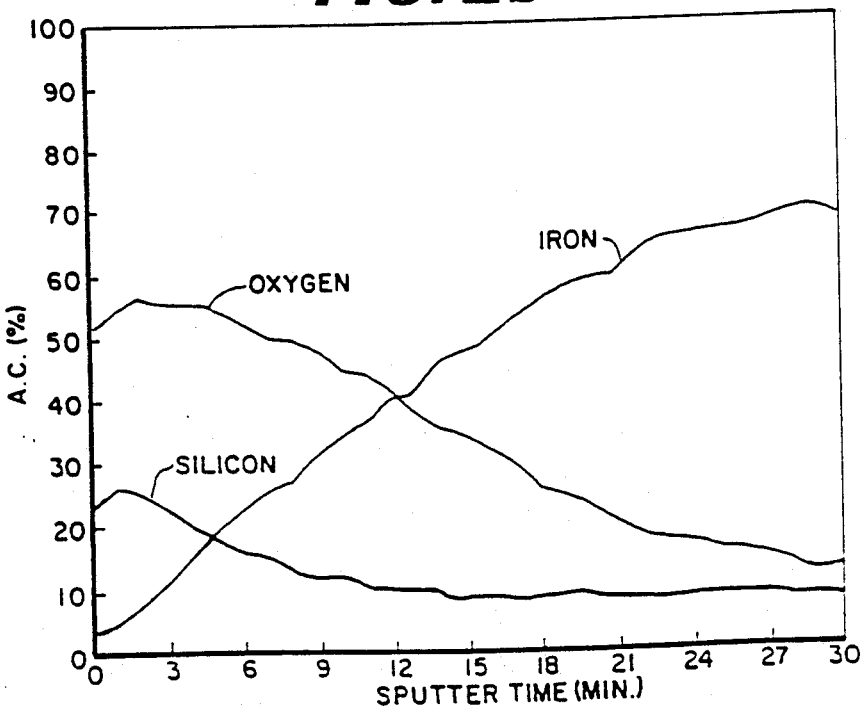
FIG. 2*b* is a plot similar to FIG. 2*a* wherein the water vapor content was maintained at 200 ppm during the silicon deposition step at 600° C.

Increasing the $H_2O$ level decreases the extent of siliconizing as evidenced by both the gravimetric uptake (weight gain, milligrams/sq. centimeter) and by the Fe/Si ratio determined by AES at the point in the depth profile at which the oxygen content was insignificant. $H_2O$ levels of 150 ppm and lower result in diffusion coatings according to the present invention. $H_2O$ levels of 200 ppm and higher will result in overlay coatings. This is demonstrated by AES depth profiles shown in FIGS. 2*a* and 2*b*. The sample surface of FIG. 2*a* was sputtered at a rate of 15 A/min for fourteen minutes and then at a rate of 150 Å/min for six minutes. The sample surface of FIG. 2*b* was sputtered at a rate of 14 A/min for thirty minutes.

Figure 3:
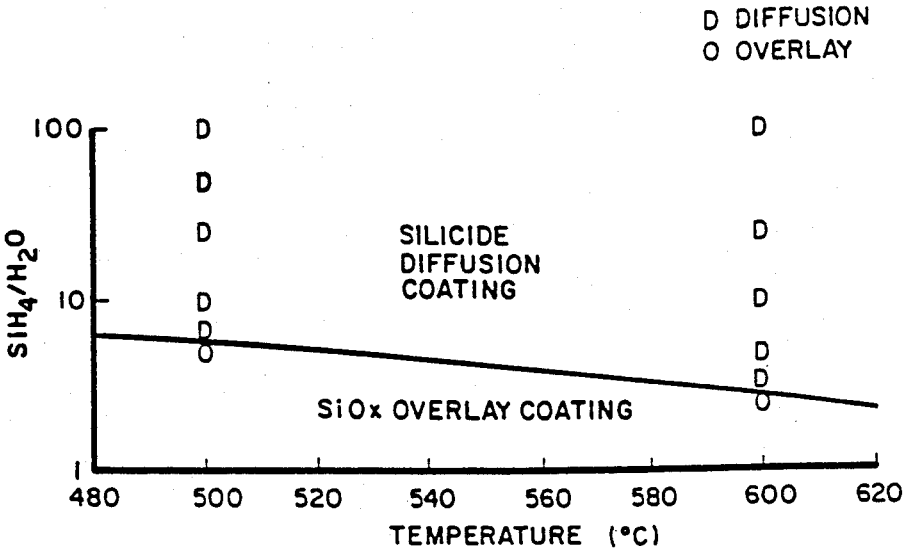
FIG. 3 is a plot of silane to water vapor ratio versus temperature showing treatments wherein either silicon diffusion coatings according to the present invention or silicon overlay coatings can be produced.

The results at 500° and 600° C. have been combined in FIG. 3 in a plot which illustrates the relationship between treatment temperature and the ratio of silane to water vapor in the atmosphere to effect either diffusion coatings according to the present invention or overlay coatings.

Example 5 was run to determine results for samples treated according to the prior art process set out in British Patent 1,530,337 and British Patent Application No. 2,107,360 A.

EXAMPLE 5

A sample of 1"×¼"×1/16" alloy A182F9 (9% Cr/1% Mo/Fe) obtained from Metal Samples Co. was suspended using a quartz wire from a microbalance inside a quartz tube positioned in a tube furnace. The sample was treated in flowing dry $H_2$ (D.P.<−60° C., $H_2O/H_2<1\times10^{-5}$) at 800° C. for 30 min. to remove C, S, and O contaminants, then cooled to 500° C. The sample was treated according to the prior art teaching at 500° C. in 2% $H_2$/He with a water vapor content less than 100 ppm (90 ppm; $H_2O/H_2=4.5\times10^{-3}$) (for 24 hr). The sample was then treated in 500 ppm $SiH_4$/2% $H_2$/(He+Ar) with a water vapor content less than 100 ppm (90 ppm; $H_2O/H_2=4.5\times10^{-3}$) at 500° C. for 24 hr. The sample was cooled rapidly in the 90 ppm $H_2O$/2% $H_2$/(He+Ar) flow.

Figure 4:
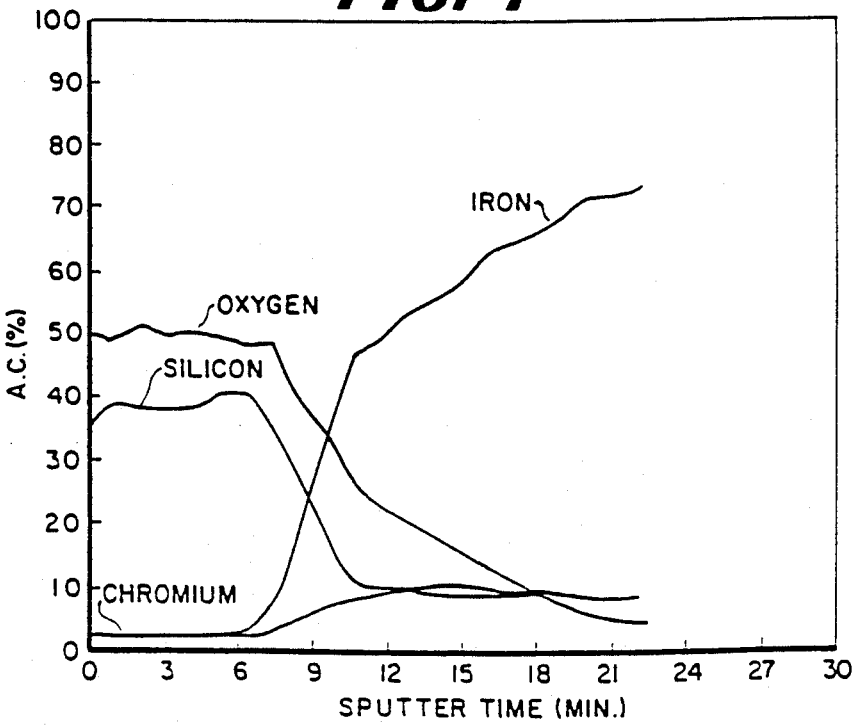
FIG. 4 is a plot of percent composition of critical elements, determined by AES, versus sputtering time for a sample treated according to the prior art using the same alloy sample as in FIG. 1*a* and FIG. 1*b*.

The AES depth profile shown in FIG. 4 illustrates that the surface is covered with an overlay coating containing silicon oxides of about 0.13 microns thick. The sample surface was sputtered at a rate of 140 Å/min for twenty two minutes. From the results set out there was no evidence of diffusion of silicon into the surface of the base metal.

There is an oxide region below the Si-containing overlay coating.

This oxide is about 500 Å thick and was probably formed during the pretreatment in 2% $H_2$/He with 90 ppm $H_2O$. The oxide is enriched in Cr relative to the concentration of Cr in the bulk. This Cr-rich oxide may be preventing diffusion of Si into the bulk.

Comparison of Example 5 to Example 4 clearly demonstrates the difference between the method of the present invention and that of the prior art for treatment of metals and alloys with $SiH_4$.

The treatment according to the present invention under reducing conditions results in a Si diffusion coating. The treatment according to the prior art results in a Si-containing overlay coating of silicon oxides. The rates of deposition are also significantly enhanced by the method of the present invention. In example 4 a 1.7 micron (μm) silicon coating was obtained (e.g. run 6) in 2.5 hours while in example 5 a 0.13 μm coating is obtained in 24 hours.

Thus considering examples 4 and 5 together, the results demonstrate the improvement of the present invention over what is believed to be the closest prior art. The two methods, although they involve similar treatments with mixtures of the same gases, yield entirely different and unexpected results. The characteristic of the method set forth in Example 5 of the prior art yields a highly oxygenated surface layer and an abrupt discontinuity between the surface layer and the substrate. This results in what is known as an overlay coating. The process according to the invention as illustrated by Example 4, on the other hand, provides a coating which varies continuously from a superficial oxide coating to a large diffused silicon layer containing both silicon and iron with a gradual transition from the high silicon surface down to the base metal. The coating produced by the process of the invention is a diffusion coating. A coating of this type will be less subject to thermal or mechanical shock than the coatings of the prior art. It will also be self-healing by providing a reservoir of silicon in the base material. A further advantage of a process according to the present invention is a relatively greater speed which the coating can be generated. With a coating according to the present invention a matter of hours is required whereas according to the prior art process several days are required to obtain a coating of the same thickness.

Example 6 demonstrates utility of a type 310 stainless steel with a selectively oxidized nickel silicide diffusion coating for inhibiting coke formation when exposed to a simulated ethane cracking environment.

EXAMPLE 6

A sample of AISI type 310 stainless steel with approximate dimensions of 0.3×0.4×0.004" was prepared, mounted, and treated as in Example 1.

The sample was heated in a 0.1% $SiH_4$ in $H_2$ mixture (by volume) at 700° C. for 15 min. at a total flow=1320 scc/min.

The sample was removed from the surface analysis system and suspended with a quartz wire from a microbalance inside a quartz tube positioned in a tube furnace. The sample was treated in dry $H_2$ at 1040° C. to reduce the surface. It was then treated in $H_2/N_2/H_2O$ at a $P_{H2O}/P_{H2}=2.1\times10^{-4}$ to form a $SiO_2$ surface film.

The sample was cooled to 850° C. and exposed to a simulated ethane cracking environment (Ethane: 120 cc/min; Nitrogen: 500 cc/min; Ethane $H_2O$ mole ratio=4) for 1 hr periods. Decoking was accomplished by turning off the ethane flow for 30 min. No detectable weight gain was observed (<0.05 μg/sec) for two coking cycles as compared to weight gains of 0.2–2.6 μg/sec in the first cycle for control runs.

Example 7 demonstrates that silicon diffusion coatings can be effectively produced on pure metals (e.g. iron) using the process of the present invention.

EXAMPLE 7

Samples of 1"×0.5"×0.002" foils of pure Fe from Alfa (99.99% pure), cleaned in an acetone sonic bath and hung from a micro balance. Samples were then treated in the following manner:

(1) Treat sample at 800° C. for 1 hr. in flowing dry $H_2$ (D.P.=−54.7° C.).
(2) Lower temperature to 500° C. and select desired dew point in the $H_2$ flow.
(3) Admit 0.5% $SiH_4/H_2$ at a flow rate that yielded a final mixture of 800 ppm in $H_2$ for 15–30 min (total flow=480 cc/min).
(4) Turn off $SiH_4/H_2$ mixture, purge with dry He and cool down to room temperature.
(5) Analyze surface composition using AES depth profiling to determine diffusion vs. overlay coating.

Using AES depth profiling, a diffusion coating is observed in a Fe sample that was siliconized at 500° C. with a mixture of 800 ppm $SiH_4$ and 25 ppm $H_2O$ in $H_2$ ($SiH_4/H_2O=32$).

The results set forth in Example 8 demonstrate that silicon diffusion coatings can be produced for high temperature oxidation protection of various metal parts.

EXAMPLE 8

A sample of 1.0×0.5×0.002" carbon steel 1010 (99.2% Fe) obtained from Teledyne Rodney Metals was suspended using a quartz wire from a microbalance inside a quartz tube positioned in a tube furnace. The sample was treated in flowing dry $H_2$ (D.P. = −60° C.) at 800° C. for 1 hour at a flow of 400 cc/min and then cooled to 600° C. The sample was then treated in a mixture of 0.12% $SiH_4$ in $H_2$ (by volume) until it gained 2 mg in weight and then cooled rapidly in flowing $H_2$. It was estimated that a $Fe_3Si$ diffusion coating of about 3 μm was formed with this treatment.

After this siliconizing step, the sample was kept under flowing He and heated up to 800° C. The gas flow was then switched to pure $O_2$ and the weight increase due to oxidation was monitored for 1 hour. The sample yielded a linear oxidation rate of 0.23 $\mu g \times cm^{-2} \times min^{-1}$ and the adhesion of the surface film was good. An untreated sample of carbon steel 1010 yielded an oxidation rate of $2.7 \times 104$ $\mu g \times cm^{-2} \times min^{-1}$ under identical conditions. Therefore, there was a reduction of $1.2 \times 10^5$ times in the oxidation rate for the siliconized sample.

EXAMPLE 9

Copper coupons (1"×¼"×1/16") were washed in a methanol sonic bath and then suspended from a microbalance using a quartz wire. The samples were positioned inside a quartz tube heated with a tube furnace, and pretreated in flowing dry $H_2$ with a dew point of less than −60° C. for 0.5 h at 500° C. At the end of the pretreatment, the dew point of the exit gas was typically −52° to −57° C. The samples were siliconized in dry. flowing 0.1% $SiH_4/H_2$ for 2 hours. Weight was monitored as a function of time to determine the amount of Si deposited. Table 6 contains the total weight gain of Si for samples siliconized at 350°, 400°, 450°, and 500° C.

Additional samples were cleaned with 1 N HCl, washed in a methanol sonic bath, and pretreated in flowing dry $H_2$ at 600° C. They were then siliconized at 350° and 500° C. The weight gains were higher than the samples pretreated at 500° C. These runs are also included in Table 6 below.

TABLE 6

Run Data of Copper Coupons Treated in 0.1% $SiH_4/H_2$ for 2 h.

| Sample | Pretreat | Treat Temp, °C. | wt gain, mg/cm² | Theoretical Thickness μm |
|---|---|---|---|---|
| 1 | $H_2$, 500° C. | 400 | 0.41 | 5.5 |
| 2 | $H_2$, 500° C. | 450 | 0.70 | 9.3 |
| 3 | $H_2$, 500° C. | 350 | 0.13 | 1.7 |
| 4 | $H_2$, 500° C. | 500 | 0.52 | 6.9 |
| 5 | $H_2$, 600° C. | 350 | 0.65 | 8.7 |
| 6 | $H_2$, 600° C. | 500 | 2.21 | 29.5 |

The rate of Si uptake for Cu was found to be extremely high. For example, even at a temperature as low as 350° C., Cu gained 0.13 mg Si/cm² in 2 h.

Several of the samples were analyzed using Auger depth profiling. The depth profiles demonstrated that treating Cu in 0.1% $SiH_4/H_2$ produces a Si diffusion coating. The topmost portion of the coating had a relatively constant Cu:Si ratio of about 3:1. Beneath this layer, the Si concentration gradually decreased.

Other copper samples siliconized in 0.1% $SiH_4/H_2$ at 400° C. and 500° C. were analyzed by X-ray diffraction. The phases detected for both samples were elemental Cu and the copper silicides:

| | |
|---|---|
| epsilon phase $\epsilon$-$Cu_{15}Si_4$ | (21 atomic % Si) |
| eta prime phase $\eta'$-(Cu,Si) | (24 atomic % Si) |

In addition, the sample siliconized at 400° C. contained $Cu_4Si$. No crystalline Si was detected for either sample. The relative proportions of the phases present were difficult to estimate because of severe intensity discrepancies caused by preferential orientation. These X-ray diffraction results confirm that treating Cu with $SiH_4/H_2$ produces Si diffusion coatings.

Siliconized and untreated copper coupons were exposed to air at 700° C. Rates of oxidation were determined using in-situ microgravimetry. The samples were siliconized at 450°, 500°, and 600° C. for a time sufficient to gain about 0.5 mg Si/cm². Samples were heated to 700° C. in flowing Ar and then exposed to zero grade air flowing at 400 cm³/min. Table 7 contains the parabolic rate constants as well as the $SiH_4$ treatment temperatures and silicon uptakes for the samples used in the oxidation experiments.

TABLE 7

Run Data of Copper Coupons Oxidized in Air (400 cm³/min) at 700° C.

| Siliconization | | Oxidation | | |
|---|---|---|---|---|
| Ctg. Thickness (mg Si/cm²) | Si Treat Temperature | Time (min.) | Wt. Gain (mg O/cm²) | Parabolic Rate (mg²/cm⁴ · min) |
| Untreated | — | 179 | 3.30 | $3.1 \times 10^2$ |
| 0.53 | 500° C. | 147 | 0.42 | $6.0 \times 10^4$ |
| 0.49 | 450° C. | 147 | 0.40 | $6.0 \times 10^4$ |
| 0.66 | 600° C. | 183 | 0.40 | $4.3 \times 10^4$ |

The parabolic rate constants for oxidation of siliconized copper coupons in air at 700° C. are all about $5.0 \times 10^{-4}$ mg²/cm⁴·min compared to a rate constant of $3 \times 10^{-2}$ mg²/cm⁴·min for untreated copper. Thus siliconizing copper decreases the rate of oxidation in air at 700° C. by a factor of about 60.

EXAMPLE 10

A 70% Cu/30% Zn brass coupon (1"×¼"×1/16") was washed in a methanol sonic bath and then suspended from a microbalance using a quartz wire. The sample was positioned inside a quartz tube heated with a tube furnace. It was pretreated in flowing dry $H_2$ with a dew point of less than −60° C. for 0.5 h at 400° C. At the end of the pretreatment, the dew point of the exit gas was less than −60° C. The sample was siliconized in dry, flowing 0.1% $SiH_4/H_2$ at 400° C. for 2 h. Weight was monitored as a function of time to determine the amount of Si deposited. The sample gained 0.13 mg/cm² during the silane treatment. The amount of Si deposited was probably more than this since some zinc volatilized and deposited on the inner wall of the hang-down tube above the top of the furnace.

The sample was analyzed using Auger depth profiling. The depth profile demonstrated that treating brass in 0.1% $SiH_4/H_2$ produces a Si diffusion coating. The Si concentration is about 28 atomic percent to the depth sputtered, about 2 μm. The zinc was slightly depleted in the surface region, and the zinc concentration increased slowly as a function of depth. Some depletion of the Zn was expected since the siliconizing reactor tube was coated with a thin layer of zinc where the tube extended out of the furnace.

In all of the following examples (11–22) the $H_2$ pretreatment step, as well as the treatment in mixtures of $SiH_4$, were carried out with dew points of −60° C. or less, except Example 22 which was carried out at a dew point of −50° C. or less.

EXAMPLE 11

A 0.005" thick molybdenum foil was washed in a methanol sonic bath, pretreated in $H_2$ at 1000° C. and siliconized in 0.1% $SiH_4/H_2$ at 650° C. to gain 0.68 mg Si/cm$^2$. About 40% of the shiny surface was covered with small circular regions of crystallized material about 0.5 mm in diameter. Microscopic examination shows the crystals grow as platelets protruding off the surface in a circular array. Auger depth profiles were obtained in both the crystallized and smooth regions. The smooth region contained a Si overlay coating about 0.5 μm thick. The crystallized region also contained a Si overlay of about 0.5 μm. Beneath the Si layer was a molybdenum silicide region about 1.4 μm thick with a relatively constant Mo:Si ratio of about 1:2. Below this region the Si concentration gradually decreased. At the point at which the depth profile was discontinued, the Si concentration was about 45 atomic percent.

The phase composition of the siliconized Mo foil was determined using XRD. Since the sample has two visibly different regions, smooth and crystallized, scans were designed to determine phases in each of these regions. A scan of the whole foil indicates the presence of Mo, strongly oriented on (100), $Mo_3Si$, low-crystalline Si, and hexagonal $MoSi_2$ phases. The foil was then cut in half, isolating the smooth region. A scan of the smooth region showed the same phases as that of the whole foil, except for $MoSi_2$. Hence $MoSi_2$ is found only in the crystallized region. The presence of $Mo_3Si$ in the smooth region is not consistent with Auger depth profiles which show only a Si overly in the smooth region.

Another Mo foil was pretreated in dry $H_2$ at 1000° C. for 0.5 h. and then treated in 0.1% $SiH_4/H_2$ (total flow 2.32 L/min) at 800° C. The sample gained 1.17 mg Si/cm$^2$ in 30 min. The face of the sample was a homogeneous dull purple gray, without the circular features observed for the sample treated at 650° C. An Auger depth profile of the sample treated at 800° C. displays a molybdenum silicide layer about 1.2 μm thick with a Mo/Si atomic ratio corresponding to $MoSi_2$. This silicide is covered with an elemental Si overlay about 1.5 μm thick.

Siliconized and untreated 0.005" thick molybdenum foils were exposed to air at 600° C. Rates of oxidation were determined using in situ microgravimetry. Samples were heated to 600° C. in flowing Ar and then exposed to zero grade air flowing at 400 cm$^3$/min. It was found that siliconizing Mo foil substantially decreases the rate of oxidation in air at 600° C. The untreated Mo foil rapidly gained 4.5 mg O/cm$^2$ in 2 h. After oxidation, the surface appears a powdery yellow to mint green. The Mo foil siliconized in 0.1% $SiH_4/H_2$ at 700° C. on the other hand, gained less than 0.01 mg O/cm$^2$ in 3 h and appeared unchanged after oxidation.

EXAMPLE 12

Coupons of Hastelloy B-2 obtained from Metal Samples, Co. Munford, Ala. (70% Ni, 28% Mo, and minor amounts of other elements) were pretreated in $H_2$ at 800° C. for 0.5 h and then treated in 0.1% $SiH_4/H_2$ at 500°, 600°, and 700° C. to gain 1.0 mg Si/cm$^2$. The weight gains were measured using in situ microgravimetry. No detectable Si deposited at 500° C., but Si deposited rapidly at 600° and 700° C. Table 8 contains the run data for the siliconization step.

TABLE 8

Run Data of Hastelloy B-2 Coupons

| Treat Temp. °C. | Treat Time, Min. | wt gain, mg/cm$^2$ | linear rate μg/cm$^2$ · min | Appearance |
|---|---|---|---|---|
| 700 | 7.6 | 1.00 | — | light grey |
| 600 | 58.0 | 0.95 | 11.6 | dark grey |
| 500 | 120.0 | n.d. | — | shiny |

Sample Size: 1" × ¼" × 1/16", surface area 4.12 cm$^2$

The rate of Si deposition for Hastelloy B-2 is much higher than the rate for molybdenum, but similar to the rates for Ni and high Ni alloys, suggesting nickel silicides form on the surface of Hastelloy B-2, catalyzing the decomposition of $SiH_4$.

Auger depth profiles for the samples confirm the surface segregation of Ni. The Si/Ni ratio was about 1.2 for both the 600° and 700° C. treatments, essentially the stoichiometry of NiSi. The NiSi layer was 2.4 μm thick for both samples, since both treatments ended when the samples gained 1 mg/cm$^2$. There was a region depleted of Ni beneath the NiSi layer, giving further evidence of Si diffusion to the surface. The Si concentration remained high in this region, indicating that Mo is also siliconized. An Auger depth profile for the sample siliconized at 500° C. indicated that even treatment at 500° C. forms NiSi. The silicide layer is very thin, about 40 nm, consistent with the absence of a detectable weight gain.

EXAMPLE 13

Experiments were performed to demonstrate the formation of W silicide diffusion coatings by the method of the present invention and their utility for oxidation protection of W at higher temperatures.

Tungsten is a refractory metal with excellent mechanical properties at high temperatures, but has no oxidation protection. Since Si forms solid solutions with W and at higher concentration produces silicides, W foils were exposed to $SiH_4$ to attempt to produce silicide-protective films in accordance with the present invention. Several samples were cut from a larger piece of W foil from Alfa Research Chemicals and Materials Co. to dimensions of 0.9×0.5×0.005". The samples were hung in a microbalance system with a quartz fiber after they were washed in acetone in an ultrasonic bath cleaner. Two samples (1 and 2) were reduced in $H_2$ at 800° C. for 1 hr., then exposed to mixtures of 0.12% or 0.3% $SiH_4$ in $H_2$ at 700° and 800° C. respectively. Weight uptake due to Si addition increased with temperature and concentration of $SiH_4$. Analysis by Auger depth profiling revealed that a Si overlay coating was formed on the sample siliconized at 700° C. (0.12% $SiH_4$). The thickness of the Si film was approximately 0.4 μm. On the other hand, the sample siliconized at 800° C. (0.3% $SiH_4$) displayed Si diffusing into the W, strongly indicating that the formation of W silicide occurred. A Si overlay was also present in this case. The diffusion zone extended at least 2.5 μm and the Si overlay was about 2 μm in thickness. XRD analysis of this sample confirmed the formation of W silicide. The silicide phase present was identified as $WSi_2$.

Two W samples (3 and 4) which were siliconized at 800° C. but at different $SiH_4$ concentrations (0.12 and 0.3%) were exposed to air at 600° C. to measure their oxidation rates. The sample siliconized in 0.3% $SiH_4$ (Sample 4) exhibited twice the Si weight uptake of the sample siliconized in 0.12% $SiH_4$ (Sample 3) and performed slightly better during the oxidation test. Significant improvements in oxidation rates were obtained for the treated samples compared with those of untreated samples. Siliconization conditions, weight uptake, and oxidation rates for Samples 3 and 4 are displayed in Table 9 below.

TABLE 9

| | Run Data of Tungsten Foils Oxidized in Air at 600° C. | | | |
|---|---|---|---|---|
| Sample | $SiH_4$ % | T °C. | Si Uptake ($mg/cm^2$) | Oxidation Rate $\mu g/min \cdot cm^2$ |
| Control | — | — | — | 12.4 |
| Sample 3 | .12 | 800 | 0.4 | 1.9 |
| Sample 4 | .30 | 800 | 0.8 | 1.3 |

EXAMPLE 14

Experiments were performed to demonstrate the high temperature oxidation protection of W wire by a W silicide diffusion coating.

Coils of 0.001" W wire were prepared having a length of about 12". The wire was reduced at 800° C. for 1 h and siliconized in 0.3% $SiH_4$ in $H_2$ at 800° C. up to 1 $mg/cm^2$. It was removed from the balance and flipped over for a second siliconization treatment. This time it was reduced only for 15 min. and siliconized to deposit an additional 1 $mg/cm^2$. This was done to assure that the ends of the coil were coated. The coil was then exposed to air at 900° C. yielding minimal oxidation. The weight uptake due to oxidation was monitored for almost 2 h. The coil was still pliable (spring-like), indicating that the W substrate was unaffected by these harsh oxidizing conditions.

EXAMPLE 15

Experiment were performed to demonstrate the formation of Pt silicide diffusion coatings by the method of the present invention.

A high purity Pt foil obtained from Alfa Research Chemicals and Materials Co. was cut into pieces with dimensions 0.5×0.5×0.004". These samples were hung from the microbalance and siliconized at three different temperatures. The samples were reduced for 1 h in $H_2$ at 800° C. and siliconized in 0.12% $SiH_4$ in $H_2$ at 500°, 600°, and 700° C. The samples siliconized at 600° and 700° C. had a light grey color, while the sample siliconized at 500° C. had a dark grey color. The coating appeared to be homogeneous in all the cases. Auger depth profiles were obtained for the samples siliconized at 600° C. and 500° C. The profiles revealed that a Pt silicide film of at least 5 μm was formed for the sample treated at 600° C. while a 3 μm thick Pt silicide coating was formed at 500° C. XRD analyses were obtained for the two same Pt samples, and the formation of Pt silicide coatings was confirmed. In the sample siliconized at lower temperature (500° C.) phases having greater Pt were observed: $Pt_3Si$ and $Pt_2Si$. While in the sample siliconized at higher temperature (600° C.) phases more Si-rich were observed: PtSi, $Pt_2Si$, $Pt_3Si$, and perhaps $Pt_4Si$.

EXAMPLE 16

Experiments were performed to demonstrate the formation of a Si diffusion coating on Au by the method of the present invention Two samples of Au foil from Engelhard Industries with dimensions of 0.5×0.5×0.002" were reduced in pure $H_2$ at 700° C. for 1 h and were siliconized in 0.12% $SiH_4$ in $H_2$ at 500° C. and 600° C. Both samples were siliconized until 1 mg of Si was added. An Auger depth profile obtained for the Au sample siliconized at 600° C. clearly indicated that Si had diffused ≈0.4 μm into the Au.

EXAMPLE 17

Experiments were performed to demonstrate the formation of a Co silicide diffusion coating by the method of the present invention.

Samples of cobalt foil were cut to dimensions of 0.9×0.5×0.004" from a larger piece of foil obtained from Alfa Research Chemicals and Materials Co. The samples were reduced in $H_2$ at 800° C. for 1 h and then siliconized at 500°, 600°, and 700° C. in 0.12% $SiH_4$ in $H_2$. The sample exposed to $SiH_4$ at 500° C. did not gain any measurable weight, indicating that very slow Si diffusion occurred. Measurable weight uptake was observed at 600° and 700° C. with Si uptake readily occurring at 700° C., while a small amount was observed at 600° C. An Auger depth profile was obtained for the sample siliconized at 700° C. which indicated that a 4.1 μm Co-silicide diffusion coating was obtained. XRD analysis was also obtained for this sample and the formation of Co silicide was confirmed. The Co silicide phases identified were CoSi as a major crystalline phase. $Co_2Si$ and $CoSi_2$ as minor phases, and elemental Co as a trace phase.

EXAMPLE 18

Experiments were performed to demonstrate the formation of a vanadium silicide diffusion coating.

Samples of V foils were cut to dimensions of 0.9×0.5×0.002" from a larger piece of foil obtained from Alfa Research Chemicals and Materials, Co. A sample was pretreated in $H_2$ at 1000° C. for 1 h and then exposed to a mixture of 0.3% $SiH_4$ in $H_2$ at 800° C. until weight uptake was observed. The sample broke in pieces during cool down. XRD analysis was obtained from one of the pieces and V silicide with a phase corresponding to $V_3Si$ was observed. This demonstrated that a V silicide diffusion coating was obtained, although hydrogen embrittlement did occur.

EXAMPLE 19

Experiments were performed to demonstrate the formation of a tantalum silicide diffusion coating.

Samples of Ta foil were cut to dimensions of 0.9×0.5×0.005" from a larger piece of foil obtained from Alfa Research Chemicals and Materials Co. Two samples were reduced in $H_2$ for at least 0.5 h and siliconized at 800° C. and 850° C. with 0.3% and 0.1% $SiH_4$ respectively. The sample that was siliconized at a $SiH_4$ concentration of 0.3% gained 1.93 mg in weight, but was easily broken due to hydrogen embrittlement. An Auger depth profile obtained from this sample indicated that Si had diffused ≈1.0 μm into the Ta.

EXAMPLE 20

Experiments were performed to demonstrate the formation of a Cr silicide diffusion coating by the method of the present invention.

Samples of Cr coupons from Metal Samples Co. with dimensions of 0.5×0.25×0.062" were reduced in $H_2$ at 800° C. for 1 h and then siliconized at 600° and 700° C. in 0.12% $SiH_4$ in $H_2$. The samples readily siliconized at 600° and 700° C. as observed by weight uptake measurements. An Auger depth profile was obtained for a sample siliconized at 600° C. which indicated that a 5.4 μm Cr-silicide diffusion coating was formed. XRD analyses were also obtained for samples siliconized at 600° and 700° C., and the formation of Cr silicide was confirmed. The Cr slicide phases identified were $CrSi_2$ as a major phase and traces of possible $Cr_3Si$ and CrSi. In both cases, a phase corresponding to bcc Cr (as a major) and traces of $Cr_2O_3$ were also observed.

EXAMPLE 21

Experiments were performed to demonstrate the formation of a Ni silicide diffusion coating by the method of the present invention and their utility for oxidation protection of Ni at higher temperatures.

Samples of Ni foil were cut to dimensions of 0.9×0.5×0.005" from a larger piece of foil obtained from Alfa Research Chemicals and Materials Co. The samples were reduced in $H_2$ at 800° C. for 1 h and then siliconized at 600° C., 650° and 700° C. in 0.08% or 0.12% $SiH_4$ in $H_2$. The samples readily siliconized at these temperatures as determined by weight uptake measurements. XRD analyses were obtained for Ni sapples siliconized at 600°, 650° and 700° C. in 0.12% $SiH_4$ and the formation of Ni silicides was confirmed. The Ni silicide phases identified were $Ni_5Si_2$ and $Ni_2Si$ for coatings that have a light gray color and NiSi for coatings that have a dark gray color.

A sample of pure Ni was reduced in $H_2$ at 800° C. for 1 h and then siliconized up to 0.54 mg/cm$^2$ of Si at 600° C. in a mixture of 0.08% $SiH_4$ in $H_2$. The siliconized foil of pure Ni was exposed to pure $O_2$ at 1000° C. and its weight uptake due to oxidation was monitored as a function of time. The oxidation proceeded in a non-linear way and it was monitored for 2 h. The average oxidation rate after 0.5 h was 1.1 μg/min·cm$^2$. An untreated Ni sample with similar dimensions was oxidized under the same conditions and yielded an oxidation rate of 10.9 μg/min·cm$^2$. Therefore, the formation of a Ni silicide diffusion coating in Ni decreased its oxidation at high temperatures by ten times.

EXAMPLE 22

Samples of Inconel 600 foil were cut to dimensions 1×0.5×0.002" from a larger piece of foil obtained from Teledyne-Rodney Co. The samples were suspended from a microbalance, pretreated in dry $H_2$ (D.P.<50° C.) at 800° C. for 0.5 h and then siliconized in 800 ppm of $SiH_4$ in $H_2$ for 15 min at 500°, 550°, 600°, 650°, and 700° C. Table 10 contains the total weight gains as determined by in situ microgravimetry.

TABLE 10

Run Data for Inconel 600 Foils Treated in 800 ppm $SiH_4/H_2$ for 15 min

| Sample Number | Temp. (°C.) | Wt. Gain (mg/cm$^2$) |
|---|---|---|
| 1 | 550 | 0.20 |
| 2 | 600 | 0.34 |
| 3 | 650 | 0.94 |
| 4 | 700 | 1.35 |

Auger depth profiles were obtained to determine the thickness and elemental composition of Si diffusion coatings on Inconel 600 prepared in 15 min using 800 ppm $SiH_4/H_2$ at 600° C. The coating contains these regimes:

(a) A thin film of silicon oxide about 20 nm thick. (A nickel silicide region about 200 nm thick high in Si with gradually decreasing Si/Ni ratio. (c) A nickel silicide region about 750 nm thick with constant estimated AES Si/Ni atomic ratio of about 55/42. (d) A metal silicide region containing Cr, Fe, and Ni with an estimated AES Si/M ratio of about 52/45. (e) A silicide/substrate interface enriched in Cr but containing no oxygen).

The total thickness of the coating determined from the profile is about 1.7 μm, within 5% of the 1.8 μm thickness calculated from the weight gain assuming NiSi forms.

The Inconel 600 foils siliconized at 550° to 700° C. were also analyzed using XRD. Since the analysis depth for this technique is about 7 μm, the pattern from the Inconel substrate appears in all the scans. In agreement with the Auger depth profiles, nickel silicides dominated the phases determined by XRD. No $Ni_2Si$ was observed, although the major nickel silicides observed, $Ni_5Si_2$ and $Ni_{31}Si_{12}$, have very similar stoichiometries. A cubic MSi phase was also observed, with isostructural forms from Cr, Fe, and Ni. If the Fe and Cr observed in the coating by the AES depth profile were present as silicides they must have existed in this phase, possibly in solid solution with Ni. Elemental Si is also present, presumably at he coating/gas interface. Table 11 lists the phases identified by XRD and the relative intensities (major, minor, trace) of their diffraction patterns.

TABLE 11

Effect of Temperature on Relative Intensities of Crystallographic Phases Determined by X-ray Diffraction Analysis of Inconel 600 Foils Treated in 800 ppm $SiH_4/H_2$ for 15 min

| | Treatment | | Crystallographic Phase | | | | | |
|---|---|---|---|---|---|---|---|---|
| Sample Number | Temp (°C.) | wt gain mg Si/cm$^2$ | INC 600 | MSi[a] | $Ni_5Si_2$[b] | $Ni_{31}Si_{12}$[b] | Si | Extra lines |
| 1 | 550 | 0.20 | maj | min | min | — | min | — |
| 2 | 600 | 0.34 | maj | maj | maj | — | min | — |
| 3 | 650 | 0.94 | maj | maj | maj | min | min | 3.09, 2.54, 1.71 |
| 4 | 700 | 1.35 | min | maj | maj | min | min | — |

[a]The cubic forms of NiSi, FeSi, and CrSi are isostructural.
[b]$Ni_5Si_2$ and $Ni_{31}Si_{12}$ have similar diffraction patterns. The presence of either cannot be ruled out.

The effect of $SiH_4$ concentration on Si deposition on Inconel 600 foil was determined by in situ microgravimetry. Samples were pretreated in dry $H_2$ (D.P.$<-50°$ C.) at 800° C. for 0.5 h and then siliconized at 600° C. for 15 min in 200 to 3200 ppm $SiH_4/H_2$. Table 12 contains the total weight gains. There is a small difference in the weight uptake during the initial period of reaction, but after the first 5 min the approximately linear slopes are all about the same.

TABLE 12

Effect of $SiH_4$ Concentration in $H_2$ on Weight Gains of Inconel 600 Foils Treated at 600° C. for 15 min

| Sample Number | $SiH_4$ concentration (ppm) | Weight Gain ($mg/cm^2$) |
|---|---|---|
| 5 | 200 | 0.27 |
| 6 | 400 | 0.28 |
| 2 | 800 | 0.34 |
| 7 | 1600 | 0.38 |
| 8 | 3200 | 0.44 |

From the foregoing examples, it is apparent that processes according to the present invention can be utilized to provide silicon diffusion in a metallic substrate. The present invention is distinguished over the prior art by the fact that the present invention teaches the use of a pretreatment to remove any diffusion barriers such as oxide films or carbon impurities on the surface of the substrate which might inhibit the deposition of the silicon on the surface and the diffusion of the silicon into the surface of the substrate. As amply demonstrated above the process is effected by carefully controlling the water vapor content of the reducing atmosphere during the pretreatment step and the water vapor content of the atmosphere and the ratio of silane to water vapor during the treatment step.

Thus according to the present invention many substrates can be given a diffusion coating of silicon which coating can subsequently be oxidized to provide a silicon dioxide coating which will resist attack under various conditons of use.

Having thus described the present invention what is desired to be secured by Letters Patent of the United States is set forth in the appended claims.

We claim:

1. A method of forming a silicon diffusion coating on the surface of a non-ferrous metal, said non-ferrous metal subject to formation of a surface oxide that can be reduced by a furnace treatment under controlled atmosphere, the steps comprising:

(a) pretreating said non-ferrous metal by heating said non-ferrous metal under conditions of, temperature less than 1200° C. under a controlled atmosphere reducing to elemental constituents of said non-ferrous metal to reduce or prevent formation of a barrier coating on exposed surfaces of said non-ferrous metal; and (b) treating said non-ferrous metal under conditions where said non-ferrous metal article can be maintained at a temperature of less than 1200° C. under a controlled atmosphere consisting of silane at least 1 part per million by volume, balance hydrogen or hydrogen and inert gas mixture wherein said atmosphere contains silane to oxygen in a molar ratio greater than 2.5 and oxygen to hydrogen in a molar ratio less than $2\times10^{-4}$ whereby silicon is diffused into the surface of said non-ferrous metal article.

2. A process according to claim 1 wherein following said treating steps said non-ferrous metal is exposed to an atmosphere containing an oxygen donor whereby at least a portion of said diffused silicon layer is preferentially oxidized to form a protective coating of silicon oxides.

3. A process according to claim 2 wherein said oxygen donor is selected from the group consisting of water vapor and hydrogen; hydrogen, nitrogen and water vapor; and hydrogen and nitrous oxide.

4. A process according to claim 2 wherein said atmosphere containing an oxygen donor is reducing to components of the non-ferrous metal at the treating temperature.

5. A process according to claim 1 wherein said pretreatment step is conducted under an atmosphere selected from the group consisting of hydrogen is less than $2\times10^{-4}$.

6. A process according to claim 1 wherein the treating step is carried out in an atmosphere consisting of 1 ppm to 5 percent by volume silane, balance hydrogen or hydrogen inert gas mixture.

7. A process according to claim 1 wherein the treatment step is carried out under an atmosphere containing 500 ppm to 5 percent by volume silane balance hydrogen.

8. A process according to claim 1 wherein said process is carried out in a single furnace in stepwise fashion under an atmosphere consisting essentially of hydrogen controlled as to, water vapor content in said pretreating step and hydrogen diluted with silane and controlled as to water vapor in said treating step.

9. A process according to claim 1 where said non-ferrous metal is maintained at a temperature of between 350° C. and 1200° C. in both said pretreating and treating steps.

10. A process according to claim 1 wherein said pretreating and said treating atmospheres are hydrogen based wherein said hydrogen has a dew point of $-60°$ C. or below.

11. A process according to claim 1 wherein said non-ferrous metal is selected from the group consisting of Cr, Cu, Mo, Ni, W, Pt, Au, Co, Ta, V, Ti and alloys thereof.

12. A process according to claim 1 wherein said non-ferrous metal is used in a high temperature oxidizing environment.

13. A process according to claim 2 wherein said non-ferrous metal is selected from the group consisting of Cr, Cu, Mo, Ni, W, Pt, Au, Co, Ta, V, Ti and alloys thereof.

14. A process according to claim 1 wherein said non-ferrous metal is copper and is maintained at a temperature of 600° C. or lower in both said pretreating and treating steps.

15. A method of protecting a non-ferrous metal, said non-ferrous metal subject to formation of a surface oxide that can be reduced by a furnace treatment under controlled atmosphere by forming a silicon diffusion coating on the exposed surface of said non-ferrous metal the steps comprising:

(a) pretreating said non-ferrous metal by heating in a furnace maintained at a temperature of at least 400° C. under a furnace atmosphere reducing to elemental constituents of said non-ferrous metal to reduce or prevent formation of a barrier film on exposed surfaces of said non-ferrous metal;

(b) treating said non-ferrous metal in a furnace maintained at a temperature of at least 350° C. under a furnace atmosphere consisting of silane at least 500 parts per million by volume balance hydrogen or hydrogen and inert gas mixture wherein said atmosphere contains silane to oxygen in a molar ratio greater than 2.5 and oxygen to hydrogen in a molar ratio less than $2\times10^{-4}$ whereby silicon is diffused into the surface of said non-ferrous metal.

16. A process according to claim 15 wherein following said treatment under silane said non-ferrous metal is exposed to an atmosphere containing an oxygen donor whereby at least a portion of said diffused silicon layer is preferentially oxidized to form a protective coating of silicon oxides.

17. A process according to claim 16 wherein said oxygen donor is selected from the group consisting of water vapor and hydrogen; hydrogen, nitrogen, and water vapor; and hydrogen and nitrous oxide.

18. A process according to claim 16 wherein said atmosphere containing an oxygen donor is reducing to components of the non-ferrous metal at treating temperature.

19. A process according to claim 15 wherein said pretreatment step is conducted under an atmosphere of hydrogen where the molar ratio of oxygen to hydrogen is less than $2\times10^{-4}$.

20. A process according to claim 15 wherein the treating step is carried out in an atmosphere consisting of 1 ppm to 5 percent by volume silane, balance hydrogen or a hydrogen inert gas mixture.

21. A process according to claim 15 wherein the treatment step is carried out under an atmosphere containing 500 ppm to 5 percent by volume silane balance hydrogen.

22. A process according to claim 15 wherein said process is carried out in a single furnace in stepwise fashion under an atmosphere consisting essentially of hydrogen controlled as to, water vapor content in said pretreating step and hydrogen diluted with silane and controlled as to water vapor in said treating step.

23. A process according to claim 15 where said furnace is maintained at a temperature of between 350° C. and 1200° C. in both said pretreating and treating steps.

24. A process according to claim 15 wherein said pretreating and said treating atmospheres are hydrogen based wherein said hydrogen has a dew point of −60° C. or below.

25. A process according to claim 15 wherein said non-ferrous metal is selected from the group consisting of Cr, Cu, Mo, Ni, W, Pt, Au, Co, Ta, V, Ti and alloys thereof.

26. A process according to claim 16 wherein said non ferrous metal is selected from the group consisting of Cr, Cu, Mo, Ni, W, Pt, Au, Co, Ta, V, Ti and alloys thereof.

27. A method of protecting a non-ferrous metal article subject to formation of a surface oxide that can be reduced by a furnace treatment under controlled atmosphere comprising the steps of:

(a) pretreating said non-ferrous metal article by heating said non-ferrous metal under conditions of. temperature less than 1200° C. under a controlled atmosphere reducing to elemental constituents of said non-ferrous metal to reduce or prevent formation of a barrier film on exposed surfaces of said non-ferrous metal;

(b) treating said article to form a silicon diffusion coating on exposed surfaces of said article; and (c) exposing said article to an oxidation treatment under an atmosphere containing an oxygen donor whereby at least a portion of said diffused silicon layer is preferentially oxidized to form a protective coating of silicon oxides.

28. A process according to claim 27 wherein said pretreatment step is conducted under an atmosphere of hydrogen where the molar ratio of oxygen to hydrogen is less than $2\times10^{-4}$.

29. A process according to claim 27 wherein the silicon diffusion coating is formed by heating said non-ferrous metal article in an atmosphere selected from the group consisting of 1 ppm to 5 percent by volume silane and 1 ppm to 5 percent by volume volatile silicon compound, balance hydrogen or a hydrogen-inert gas mixture.

30. A process according to claim 27 wherein the silicon diffusion coating is formed by heating said non-ferrous metal article under an atmosphere containing 500 ppm to 5 percent by volume silane balance hydrogen.

31. A process according to claim 27 wherein said oxygen donor is selected from the group consisting of water vapor and hydrogen; hydrogen, nitrogen and water vapor; and hydrogen and nitrous oxide.

32. A process according to claim 27 wherein said process is carried out in a single furnace in stepwise fashion under an atmosphere consisting essentially of hydrogen controlled as to. water vapor content in said pretreating step and hydrogen diluted with silane and controlled as to water vapor in said treating step.

33. A process according to claim 27 where said non-ferrous metal is heated to a temperature of between 350° C. and 1200° C. in both said pretreating and treating steps.

34. A process according to claim 27 wherein said pretreating and said treating atmospheres are hydrogen based wherein said hydrogen has a dew point of −60° C. or below.

35. A process according to claim 27 wherein said non-ferrous metal is selected from the group consisting of Cr, Cu, Mo, Ni, W, Pt, Au, Co, Ta, V, Ti and alloys thereof.

* * * * *